US006279627B1

(12) United States Patent
Kelly

(10) Patent No.: US 6,279,627 B1
(45) Date of Patent: Aug. 28, 2001

(54) DRIPLESS CLOSURE

(76) Inventor: Robert J. Kelly, 2711 Halladay St., North Port, FL (US) 34287

( * ) Notice: Subject to any disclaimer, the term of this patent is extended or adjusted under 35 U.S.C. 154(b) by 0 days.

(21) Appl. No.: 09/633,512

(22) Filed: Aug. 7, 2000

Related U.S. Application Data

(60) Provisional application No. 60/148,004, filed on Aug. 10, 1999.

(51) Int. Cl.[7] ..... B65B 3/00; B67D 5/33

(52) U.S. Cl. ..... 141/352; 141/351; 222/153.06; 222/482; 222/522; 222/545; 222/568

(58) Field of Search ..... 222/153.06, 153.05, 222/481, 482, 522, 541.6, 559, 545, 544, 568, 566, 153.14; 141/346, 351, 352, 353, 349

(56) References Cited

U.S. PATENT DOCUMENTS

| | | | | |
|---|---|---|---|---|
| 1,952,586 | * | 3/1934 | Cruze et al. | 222/545 |
| 2,347,737 | * | 5/1944 | Fuller | 222/522 |
| 2,700,484 | * | 1/1955 | Rathsprecher | 222/482 |

* cited by examiner

*Primary Examiner*—Kevin Shaver
*Assistant Examiner*—Patrick Buechner
(74) *Attorney, Agent, or Firm*—Gifford, Krass, Groh, Sprinkle, Anderson & Citkowski, P.C.

(57) ABSTRACT

A leak proof package for fluid materials in which the end of a tubular nozzle from a container is closed by a wall and dispensing openings are formed in the side of the nozzle to extend radially. The dispensing openings are closed by a sleeve which initially is fixed to the wall. The sleeve is separated from the wall along a line of frangible webs by twisting the sleeve relative to the nozzle to fracture the webs after which the sleeve slides axially of the nozzle between positions opening or closing the dispensing openings in the nozzle.

14 Claims, 2 Drawing Sheets

DRIPLESS CLOSURE

This application claims the benefit of Provisional Patent Application Ser. No. 60/148,004 filed Aug. 10, 1999.

FIELD OF THE INVENTION

This invention relates to closures and containers and particularly to the dispensing of liquids such as petroleum oil from a container.

BACKGROUND OF THE INVENTION

Many products such as motor oil, solvents, soap and like products are bottled or packaged in plastic containers having a neck offset to one side of the main body of the container and closed by a screw type closure. Such closures require the total removal of the threaded cap, which exposes the contents of the container to the atmosphere. When attempts are made to pour or empty the contents of the container into another receptacle, spillage typically occurs. Particularly in the case of oil for the crank cases of automotive engines, space usually does not permit the container of oil to be gradually tilted to obtain uniform flow. Also, once flow is obtained and the container is inverted it is difficult if not impossible to stop overflow problems, which cause spillage. Additionally, the design of such containers often is such that air equalization causes the contents to surge resulting in spillage. Also, once such containers are inverted, it is not possible to interrupt flow without spillage.

There is a need for improved container or container closure combination which eliminates the aforementioned problems with the pouring of liquid from one container into a receiving opening in a container or a fill pipe for the crank case of an automobile engine.

SUMMARY OF THE INVENTION

It is an object of the invention to provide an improved closure-container combination or a closure for use with a variety of threaded containers.

It is a further object of the invention to provide such package or closure, which allows for the pouring from plastic bottles without spillage.

Still another object of the invention is to provide such a package or closure which is drip free and which can accommodate different size liquid receiving ports without the need for separate funnels and the like.

Still another object of the invention is to provide an improved closure-container or closure, which allows the flow of liquid to be terminated anytime before the contents of the container are completely emptied and also permits regulation of the rate of flow from the container.

Another object of the invention is to provide a dispensing package or closure which can be placed in an inverted dispensing position relative to the receiving container but remains in a closed position after which it can be open to insure that all of the material is dispensed into the receiving container without drip or splash.

Yet another object of the invention is to provide a container-closure or closure for containers, which facilitates threading of a package in its closed condition relative to a receiving container, after which the closure can be opened to insure a transfer of materials from the container to the receiving container without escape of fumes or liquid.

The objects of the invention are attained by a container closure package, which includes a container having a body portion with a tubular neck, or pouring spout in which the end of the pouring spout is closed. Passage means in communication with the container are through passages in the side of the pouring spout, which in a closed position are closed by a tubular sleeve slidable on the exterior of the pouring spout, but initially fixed to the container to form a unitary structure through means of a frangible line of weakening. After fracture of the frangible connection the sleeve can be moved between open and closed positions to dispense material from the container.

In another embodiment of the invention the package is provided with external threads for threading into a receiving opening of another container so that materials can be transferred without the escape of fumes or liquid.

The objects of the invention are attained by a two-part closure structure in the form of a tubular spout and a sliding closure or sleeve. The closure structure is incorporated directly into the container finish or neck. In the case of a threaded closure a tubular body member is closed at one end and is threaded at its opposite end to receive matching threads on a container neck. The tubular body member is provided with radially extending openings from which the contents of the container can be emptied. The radially extending openings are closed by a slidable sleeve which in the closed position obstructs the radially extending passages and which can be slid downwardly on the tubular portion a predetermined amount to open the radially extending ports a selected amount to dispense liquid from the container. The sleeve is provided with a flange at one end, which extends radially outwardly from the axis of the tubular member and can be used to open and close the container. For example, opening can be accomplished by inverting the package and holding the flange stationary on an edge of an opening into a receiving receptacle. Subsequently, moving the container downwardly causes the sleeve to slide to an open position relative to the tubular body member to dispense the contents without dripping or splash.

In the case of the container, the tubular neck or finish of such containers can be closed and provided with radially opening dispensing ports adjacent to the closed top. The slidable sleeve on the tubular neck closes the radially extending ports and a flange on the bottom of the sleeve can be held stationary or can be moved to slide the sleeve on the spout and expose the ports.

DETAILED DESCRIPTION OF THE PREFERRED EMBODIMENT

Figure 1:
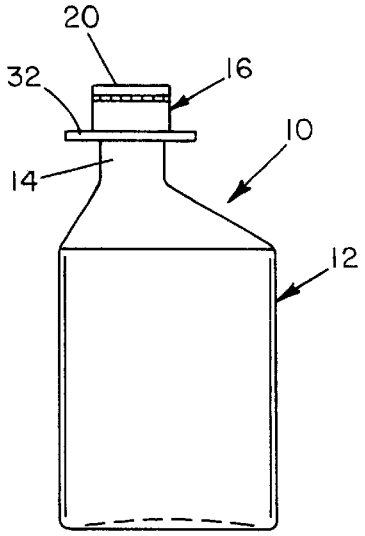
FIG. 1 is a side elevation of package embodying the invention.

The two major components of the package 10 embodying the invention are a container portion 12 having a cylindrical pouring spout 14 and closure portion 16 including a tubular sleeve 18 fitting over the exterior of the cylindrical spout 14.

Figure 3:
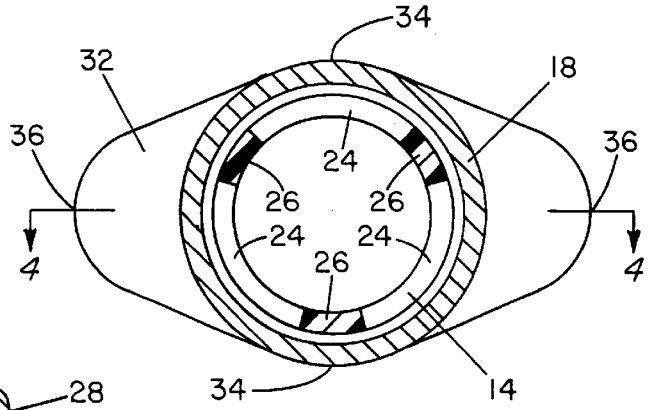
FIG. 3 is a cross-sectional view taken on line 3—3 in FIG. 2.
Figure 4:
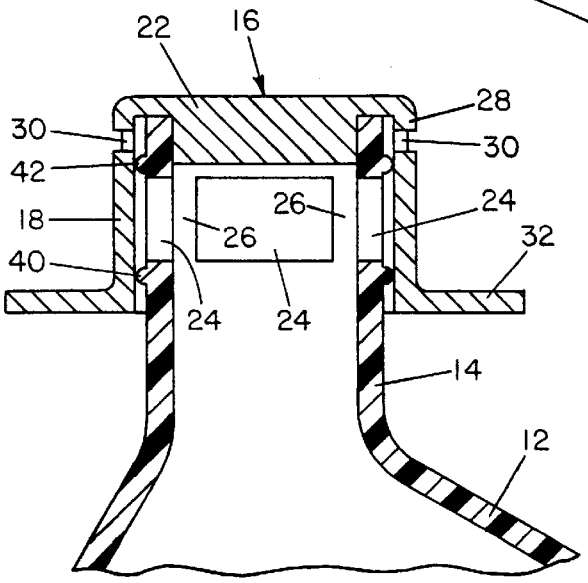
FIG. 4. is a cross-sectional view taken on line 4—4 in FIG. 3.

The cylindrical spout 14 of the container portion 12, as best seen in FIG. 4, is closed by a top wall member 20. The top wall member 20 has a plug portion 22, which fits tightly into the upper end of the spout 14 and is intended to be fixed to the internal wall of the spout 14. If desired, the pressed fit of the plug 22 can be further secured with adhesive or welding to fuse the materials together to make a permanent connection. Access to the contents of the container portion 12 is through radially extending openings 24 as seen in FIGS. 3 and 4. In FIG. 3, three openings 24 are shown separated by posts 26. It should be understood that more openings or less openings could be provided. In the closed condition of the package 10, the sleeve 18 covers the radial extending openings 24.

The upper end of sleeve 18 is connected to an annular lip 28 of wall 20 by circumferentially spaced webs 30 which form a frangible connection between the wall 20 and the sleeve 18. After fracture of all of the webs 30, the sleeve 18 is rotatable and axially slidable on the spout 14 between a closed position as seen in FIGS. 2 and 4 and an open position as shown in FIG. 5.

As seen in FIG. 3, the bottom end of the sleeve 18 is provided with a flange 32 having a generally oval configuration so that diametrically opposed edges 34 are adjacent to the outer surface of the sleeve 18 and diametrically opposed edges 36 are radially spaced away from the side walls of sleeve 18. The flange 32 provides a grip for twisting the sleeve 18 relative to the top wall 20 to break the frangible webs 30 to free the sleeve 18 from the stationary wall 20 for opening of the package 10 by sliding the sleeve 18 axially away from wall 20 on the spout 14 to expose the radial dispensing openings 24.

Figure 2:
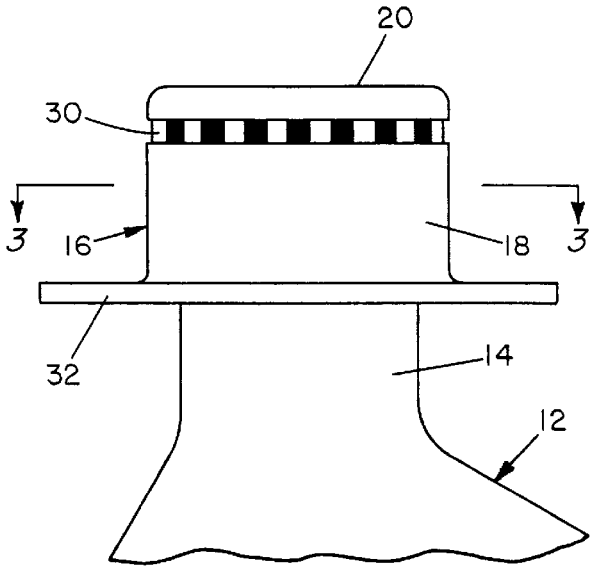
FIG. 2 is an enlarged portion of FIG. 1.
Figure 5:
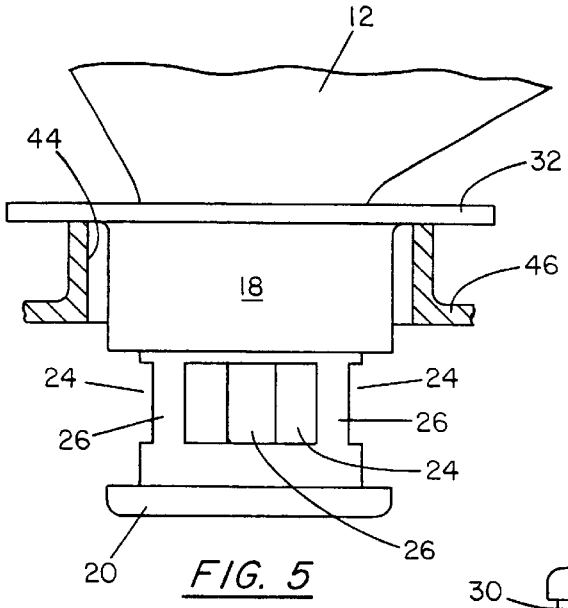
FIG. 5 is a view of the package embodying the invention in an inverted position during the pouring process.
Figure 7:
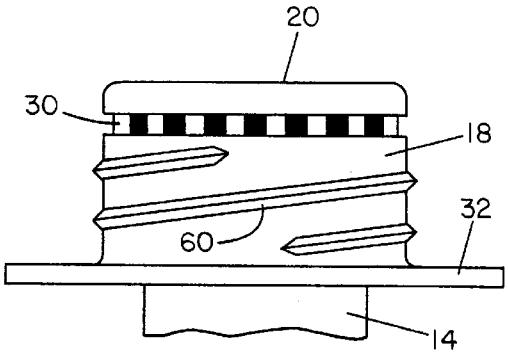
FIG. 7. is a view similar to a portion of FIG. 2 showing still another embodiment of the invention.

The closed position is shown in FIGS. 2 and 4 and an open position is shown in FIG. 5.

The container 12 can be filled with a product such as motor oil through the open pouring spout 14. After filling, the container 12 can be closed by pressing the closure 16 into position with plug 22 in the open end of spout 14. As mentioned previously, the pressed fit is sufficient to fix container 12 and closure 16 relative to each other but if desired a more permanent and secure connection can be made by use of adhesive or by fusion with heat to form a unitary assembly or package 10. Both container and closure can be injection molded of the same plastic material to form the unitary assembly. However, it may be desirable, in some instances, to use different plastic materials to reduce friction of like material and facilitate sliding movement of sleeve 18 relative to the neck or spout 14. Also the container 12 and closure 16 can be of a different color.

Use of the filled package 10 entails opening of the closure portion 16 by twisting the sleeve 18 on the neck or spout 14 to cause relative movement of the sleeve 18 and the top wall 20 causing fracture of the webs 30. Axial sleeve movement is permitted in the range between a closed position in which movement of the sleeve is limited by the annular lip 28 which keeps the sleeve 18 captured on the spout 14 and an open position determined by the juncture of the spout or neck 14 with the body of the container 12.

The outer surface of the pouring spout or neck 14 can be provided with an annular sealing bead 40 on the outer wall of the spout 14 below the radial openings 24. An additional annular seal 42 can be provided immediately above the openings 24 to maintain alignment of the sliding sleeve 18 in its closed position.

After separation of the sleeve 18 from the top wall 20, movement of the sleeve 18 between open and closed position can be accomplished manually by gripping the flange 32 and moving the sleeve 18. The usual procedure for dispensing of contents of the container 12 after the webs 30 have been broken but with sleeve 18 in the closed position is to invert the container 12 to place the pouring spout or neck 14 into an opening such as the opening 44 that might be found on a valve cover 46 of an automotive engine. With the container 12 inverted but still closed, the flange 32 can be placed into engagement with the edge or lip of the opening 44 after which the container 12 can be pushed downwardly to slide the sleeve 18 relative to the spout 14 to expose the radial openings 24. Even if there should be a surge of the contents of the container 12 as the air equalizes in the container 12, there will be no spillage because the dispensing openings 24 will be disposed below the entrance to the opening 44.

If it is desired to interrupt fluid flow, the flange 32 can be held in engagement with the edge of the opening 44 and the container 12 can be moved upwardly relative to the stationary flange 32 to bring the sleeve to its closed position covering the radially extending openings 24 thereby interrupting fluid flow. Also the rate of flow can be controlled by moving the sleeve 18 to a selected intermediate position in which the openings are only partially exposed.

Figure 6:
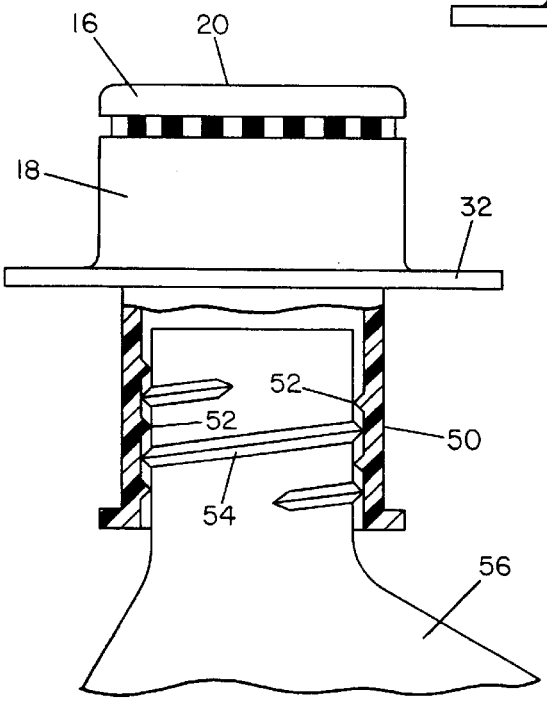
FIG. 6 is a partial cross-sectional view showing another embodiment of the invention.

Another embodiment of the invention is shown in FIG. 6 in which the closure part showed in 16 of the package 10 performs as a separate closure for threaded engagement with a variety of containers having threaded necks. In this embodiment of the invention, closure portion 16 is fitted on a cylindrical sleeve 50 instead of neck or spout 14 as shown in FIG. 6. Sleeve 50 is provided with internal threads 52 complementary with external threads 54 on a neck of a container 56 with which the closure is to be used. In use, this embodiment of the invention operates in the same manner as the first embodiment shown in FIGS. 1 through 5. Filling of the container 56 can be accomplished in the usual manner before the closure including the sleeve 50 is threaded onto container threads 54.

Figure 8:
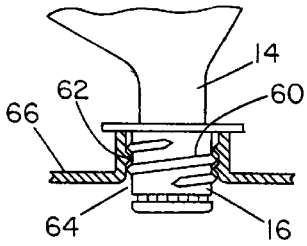
FIG. 8 is a view of the embodiment in FIG. 7 but at a smaller scale showing a pouring position.

Another variation of the invention can be provided by forming external threads 60 on the outer surface of sleeve 18 of the closure 16. The external threads 60 are intended for complementary threaded engagement with internal threads 62 on the inner wall of an opening 64 in a closed container 66 as seen in FIG. 8. In such an arrangement it is possible to thread an inverted container into a complementary opening and to dispense liquid or other material from a container 12 by twisting the container relative to the stationary closure to fracture the webs 30 after which the container 12 can be moved downwardly to open the ports or openings 24. The open container 12 then permits gravity flow of the contents of the container 12 to the other container 66. Upon completion of flow the openings 24 in spout 14 or sleeve 50 can be closed by moving the container 30 upwardly. This makes it possible for a complete transfer of the contents of the container 12 to the second container 66 with a minimum escape of any noxious or toxic fumes that might exist. Thereafter, the sleeve 18 can be unthreaded from the threaded opening 64 and the package or container removed with a minimum escape of fumes.

A package has been provided in which a container 12 and closure 16 can form a unitary package or in which a closure embodiment on a threaded container can be used to open and close the closure portion by axially moving a sliding sleeve to exposed radial openings. Such opening movement can occur after the container has been placed in a pouring position. In one variation of the invention, the container can be inverted to a pouring position and threaded into threaded engagement with a receiving container to receive the contents of the first container with a minimum escape of fumes.

I claim:

1. A container-closure package comprising:

a container having a body portion;

a tubular pouring spout connected to and communicating with said body member;

a wall closing one end of said tubular pouring spout;

passage means in the side walls of said tubular pouring spout communicating with the other end of said pouring spout; and a tubular sleeve axially slidable on the exterior of said tubular pouring spout and having a first position closing said passage means, said sleeve being moveable axially away from said wall to a second position to open said passage means.

2. The container-closure package of claim 1 wherein said tubular sleeve is provided with external threads adapted to engage complementary internal threads on a receiving container.

3. The container-closure package of claim 1 and further comprising a plurality of webs disposed circumferentially of and at one end of said tubular sleeve forming a frangible connection between said wall and said sleeve.

4. The container-closure package of claim 1 wherein said tubular pouring spout is provided with internal threads and said container has a neck forming external threads complementary to said internal threads on said tubular pouring spout.

5. The container-closure package of claim 1 wherein diameter of said wall is larger than the inner diameter of said tubular sleeve to form an annular stop for said tubular sleeve after it has been separated from said wall.

6. A container-closure package comprising:

a container having a body portion and a tubular neck portion extending from and communicating with the interior of said body portion;

a wall closing the free end of said neck portion;

passage means extending radially of the axis of said neck and forming an exit from said container; and a tubular sleeve slidable on the exterior of said tubular neck and movable axially between a first position adjacent said wall and closing said passage means and a second position spaced away from said wall and opening said passage means.

7. The container-closure package of claim 6 wherein said passage means include a plurality of dispensing openings distributed circumferentially of said tubular neck portion.

8. The container-closure package of claim 6 and further comprising exterior threads formed on an exterior surface of said tubular sleeve and adapted for threaded engagement with a material receiving opening in another container.

9. A container-closure package as set forth in claim 6 and further comprising a neck finish on said container having external threads, said tubular neck portion being separate from said container and having internal threads for engagement with said external threads on said container.

10. The container-closure package of claim 6 wherein a flange extends radially from a bottom portion of said sleeve relative to said tubular neck portion axially and circumferentially to form a handle for manipulating said sleeve.

11. The container-closure package of claim 10 wherein said flange is engageable with the edge of an opening of a receiving container to hold said sleeve stationary while said container is moved from said closed to said open position of said passage means.

12. The container-closure package of claim 6 wherein said wall is fixed to the free end of said tubular neck portion and is provided with a plurality of webs forming a circumferential, frangible line of weakening between said wall and said tubular sleeve.

13. The container-closure of claim 12 wherein said wall is connected to said tubular neck portion by a plug forming part of said wall pressed into the open end of said tubular neck portion.

14. The container-closure package of claim 12 wherein a flange extends radially from said sleeve for twisting of said sleeve relative to said wall to fracture said webs for separation of said wall and sleeve.

* * * * *